US007000267B2

(12) United States Patent
Chesters

(10) Patent No.: US 7,000,267 B2
(45) Date of Patent: Feb. 21, 2006

(54) PORTABLE RECYCLABLE FLUID FLUSHING METHOD

(76) Inventor: Thomas Peter Chesters, 1901 Marigold La., Hanover Park, IL (US) 60133

( * ) Notice: Subject to any disclaimer, the term of this patent is extended or adjusted under 35 U.S.C. 154(b) by 54 days.

(21) Appl. No.: 10/453,384

(22) Filed: Jun. 3, 2003

(65) Prior Publication Data

US 2004/0244106 A1 Dec. 9, 2004

(51) Int. Cl.
*A61H 33/00* (2006.01)

(52) U.S. Cl. ..... 4/620; 604/290; 604/294; 604/297; 222/318; 222/383.3

(58) Field of Classification Search ..... 4/620, 4/625–627; 604/289, 290, 294–303, 310; 222/318, 383.3, 189.06; 239/124, 125, 122, 239/505, 507

See application file for complete search history.

(56) References Cited

U.S. PATENT DOCUMENTS 1,121,667 A * 12/1914 Ross ..... 604/297

(Continued)

FOREIGN PATENT DOCUMENTS

DE 3800499 A1 * 7/1989

OTHER PUBLICATIONS

MYCELX Technologies Corp., primary web site contents from Apr. 20, 2003, http://www.mycelx.com, USA.
Safety Central, BioShield Tear Gas and Pepper Spray Neutralizer from Apr. 13, 2003, www.safetycentral.com.

*Primary Examiner*—Gregory L. Huson
*Assistant Examiner*—Khoa Huynh

(57) ABSTRACT

A small-scale portable recyclable fluid flushing method used for flushing irritants or inflammatory agents from the skin or eyes, or for flushing infectious debris from wounds. The invention is either made reusable or disposable, and typically comprises: a. a single or plurally chambered container with at least one flushing fluid chamber filled with an uncontaminated flushing fluid appropriate for the intended flushing procedure; b. a first outflow fluid conduit, e.g., a channel or tube, which transports uncontaminated fluid from the container flushing fluid chamber to a pump or impeller housing; c. a manual or electrically operated pump or impeller for transporting uncontaminated fluid through to a second outflow fluid conduit to a dispersal outlet or nozzle; d. a fluid runoff collector surrounding the dispersal outlet, or a catch basin situated below the dispersal outlet, either of which acts as a sump to capture the contaminated runoff fluid from the flushing procedure; e. a first drain fluid conduit; f. an optional one-way elastomeric drain valve, e.g., a synthetic polymer duckbill valve, such as silicone rubber, or other form of check valve preceding the first drain fluid conduit to avoid reverse flow spillage; g. an appropriate sealed filter media unit suitably housed in line with the first drain fluid conduit for decontamination of the contaminated fluid run-off from the drain; h. a second drain fluid conduit to re-introduce the reclaimed decontaminated fluid from the sealed filter media back into the flushing fluid chamber for re-introduction to the fluid transport system; i. an optional second outflow fluid filter for final removal of any residual contaminants prior to re-introduction to the first outflow fluid conduit. The portable recyclable fluid flushing method of the invention provides a reliable emergency supply of flushing fluid for continuous flushing dispersal onto an affected body part. Typically, the filtering media used will have visual indicators to warn when the useful life of the media is ending.

20 Claims, 6 Drawing Sheets

U.S. PATENT DOCUMENTS 3,841,484 A 10/1974 Domnick
4,493,119 A * 1/1985 Baumann ..... 4/620
4,641,384 A 2/1987 Landsberger
4,650,461 A 3/1987 Woods
4,758,237 A 7/1988 Sacks
5,030,214 A * 7/1991 Spector ..... 604/301
5,320,615 A * 6/1994 Van Keuren ..... 604/297
5,437,793 A 8/1995 Alper
5,643,200 A * 7/1997 Edwards ..... 604/27
5,921,444 A * 7/1999 Fuchs ..... 604/301
6,180,010 B1 1/2001 Alper
6,406,447 B1 * 6/2002 Thrash et al. ..... 601/160

* cited by examiner

PORTABLE RECYCLABLE FLUID FLUSHING METHOD

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field of the Invention

This invention relates to small-scale portable fluid flushing methods and their implementation devices, and more specifically to a small-scale portable recyclable fluid flushing method used for the emergency flushing of irritants or inflammatory agents from the skin or eyes, or for flushing infectious debris from wounds when no other fluid source is available.

2. Description of Prior Art

Small-scale portable fluid flushing devices for the flushing of the eyes and skin, or for flushing wounds, are self-contained supplementary flushing fluid units intended to be used only under exigent circumstances as an emergency resort when no other flushing fluid source is available. The American National Standard for Emergency Eye Wash and Deluge Shower Equipment, ANSI Z358.1-1998, states that "Medical and industrial experiences have shown that the initial first aid treatment for chemical splash should be to wash the eyes for the minimum 15 minutes prior to first aid treatment. It is important to hold the eyelids open and roll the eyeballs so that the flushing solution used will flow on all surfaces and in the folds surrounding the eyeballs." It is also cited that the first 10 seconds after having toxic substances coming in contact with the eye are the most critical as that is the brief amount of time during which one must begin flushing the substance away before damage begins to sensitive eye tissues. Similarly, it is recommended by most medical authorities that minor wounds and abrasions, e.g. gravel rash from a fall, or cuts, or deep scratches, or penetrating wounds such as from animal bites or from a fish hook, be immediately flushed of dirt or other foreign debris with sterile or clean water as a first aid measure to lessen the risk of infection prior to emergency bandaging with any clean cloth material.

Prior art small-scale prior art portable fluid flushing methods for the emergency flushing of the eyes and skin, or for flushing wounds, typically have implementation devices which are simple and easy to operate. Generally a prior art small-scale portable flushing container will hold a limited supply of flushing fluid, typically in the range of 118 ml to 472 ml (4 to 16 oz), or a larger predetermined supply. Usually the flushing fluid is sterile or clean water, or a water-based solution for eliminating chemicals from the eyes or skin, or for flushing dirt and debris from a wound. The various prior art eye, skin or wound flushing methods respectively have appreciated features such as easy to use fluid containers which typically utilize either squeezable bottles, or pressurized containers, or manually or electrically operated dispersal pumps. Some of the portable flushing methods and devices intended for eye flushing have a manually operated bladder or a gravity-operated streaming water dispersal system typically utilizing capped dispersal outlets which when uncapped allow water to flow upward into the eyes. Some of the prior art devices also capture the contaminated spillage and runoff for later disposal.

The majority of prior art references which consider portable fluid flushing methods and their implementation devices do so with a view toward making improvements on the form or manner in which the emergency flushing fluid is housed and dispersed, or how the flushing delivery system itself will operate. Only one prior art reference located concerning small-scale portable flushing devices considers the possibility of a filtered recycling of a fixed amount of flushing liquid under containment, but the overall purpose and method of the filtering media and the dispersal device in the reference is clearly distinct from the overall purpose and method of the filtering media and dispersal devices utilized in the present invention.

U.S. Pat. No. 4,758,237 issued to Herman Sacks on Jul. 19, 1988, entitled "Device for Applying Liquid to the Corneal Surface of the Eye", discloses a device for transversely circulating an eyewashing liquid, such as boric acid, which is applied to the eye via an upwardly disposed eyecup during the recirculation process to provide a gentle transverse rinse across the surface of a downward-facing eye. A filter material such as Dacron is incidentally added into the fluid circulation system of the device specifically to remove dust and debris. There is no mention in the Sacks patent specification nor in the independent claim that the filtering media is essential to the operation of the device, nor any anticipation that the filtering media should or could be of a type that will remove specific chemicals during the recirculation process prior to fluid reintroduction to the eye. There is also no indication in this reference that the device should or could utilize a manually operated pumping mechanism. Additionally, the gentle flushing process described and claimed in the reference would be insufficient for the type of more forceful flushing necessary to operate in terms of the method of the present invention. The reference as described and claimed does not anticipate, nor could it function in the method of the present invention.

A second small-scale prior art reference, U.S. Pat. No. 4,650,461 issued to Randall L. Woods on Mar. 17, 1987, entitled "Extracapasular Cortex Irrigation and Extraction", discloses a device for recirculating an irrigation fluid through various types of filters. The design and method of the device limits it to exclusive use for the surgical art of extracapasular cataract extraction and thus the device would serve no useful purpose in terms of the design or method of the present invention. No portion of the Woods patent specification or claims indicates a further use for the device as a portable flushing method for the external portions of the eyes, or for flushing the skin or for flushing a wound.

All of the presently known small-scale prior art portable flushing devices used for the emergency flushing of the eyes, skin or for flushing wounds, are limited in the amount of useable flushing fluid that can be easily carried and used in a crisis situation before a refill or replacement of the fluid container is necessary. No known small-scale prior art portable flushing method or device has thus far been designed to capture contaminated runoff and spillage fluid with the intent to filter out contaminants from a recyclable fluid dispersal stream so that a limited fluid supply may be immediately filtered and reused for flushing purposes under emergency circumstances, i.e. where no other clean fluid supply is available. The critical need for such a small-scale portable recyclable fluid flushing method presents itself, for example, when an isolated victim of a chemical spray or spill is temporarily blinded, or in pain from a chemical burn, or, for example, when a wound victim is unable to immediately obtain emergency treatment prior to first-aid bandaging.

SUMMARY

A small-scale portable recyclable fluid flushing method used for flushing irritants or inflammatory agents from the skin or eyes, or for flushing infectious debris from wounds. The invention is either made reusable or disposable, and typically comprises: a. a single or plurally chambered container with at least one flushing fluid chamber filled with an uncontaminated flushing fluid appropriate for the intended flushing procedure; b. a first outflow fluid conduit, e.g., a channel or tube, which transports uncontaminated fluid from the container flushing fluid chamber to a pump or impeller housing; c. a manual or electrically operated pump or impeller for transporting uncontaminated fluid through to a second outflow fluid conduit to a dispersal outlet or nozzle; d. a fluid runoff collector surrounding the dispersal outlet, or a catch basin situated below the dispersal outlet, either of which acts as a sump to capture the contaminated runoff fluid from the flushing procedure; e. a first drain fluid conduit; f. an optional one-way elastomeric drain valve, e.g., a synthetic polymer duckbill valve, such as silicone rubber, or other form of check valve preceding the first drain channel or tube to avoid reverse flow spillage; g. a suitable sealed filter media unit suitably housed in line with the first drain fluid conduit for decontamination of the contaminated fluid run-off from the drain; h. a second drain fluid conduit to re-introduce the reclaimed decontaminated fluid from the sealed filter media back into the flushing fluid chamber for re-introduction to the fluid transport system; i. an alternate or optional second outflow fluid filter for final removal of any residual contaminants prior to re-introduction to the first outflow fluid conduit. The portable recyclable fluid flushing method of the invention provides a reliable emergency supply of flushing fluid for continuous flushing dispersal onto an affected body part. Typically, the filtering media used will have visual indicators to warn when the useful life of the media is ending.

Objects and Advantages

Accordingly, the present invention of a small-scale portable recyclable fluid flushing method has the primary object of providing various types of portable recyclable fluid flushing devices with appropriate fluid-decontaminating systems to be used for the sustained emergency flushing of irritants or inflammatory agents from the skin or eyes, or for flushing infectious debris from wounds. It is also an object of the invention to provide portable recyclable flushing devices embodied in three manually or electrically operated basic formats: a. as a portable handheld device with a catch basin and/or an eyecup drain; b. as an extendible delivery and recovery tube system with a fluid dispersal outlet and a fluid-suctioning recovery inlet system connected to a filtration cartridge and a fluid transport system; or, c. as a portable, free-standing device with a directed fluid dispersal system flexibly positioned over a catch basin.

The invention has numerous additional objects and advantages. The invention retains the advantages of the prior art of being a simple and intuitive method with implementation devices which are either able to be kept within easy grasp on or near a user's work area, or which are made sufficiently small and lightweight to be carried on the user's person, e.g., by military personnel, law enforcement officers, fire fighters, chemical or hazardous material workers, or miners.

Although the various implementation devices of the invention utilize the typical flushing function features of the prior art in that each has a fluid container utilizing a fluid transport system terminating in a directable and/or adjustable dispersal rate outlet or nozzle, the various implementation devices of the invention have an advantage over the prior art of being able to provide a continuously recycling supply of reusable, decontaminated flushing fluid to sustain the flushing process. This is a particularly useful feature when a victim has been struck by Oleoresin Capsicum (OC, i.e. liquid pepper spray), tear gas, or Mace™, or other chemicals which are difficult to flush from the eyes and skin. Additionally, the invention utilizes inexpensive components and is relatively easy to manufacture, maintain, and repair.

Other objects of the present invention of a portable recyclable fluid flushing method and its implementation devices are to provide: a. various types of portable containers, flushing fluids, specialized filtering media, alternate fluid transport mechanisms, alternate fluid-runoff capturing systems, and alternate fluid dispersal outlet mechanisms which will serve a variety of specialized emergency purposes; b. a method of spatial distribution and configuration of standard and modified portable flushing components that offers a significantly different, more efficient and practical, as well as more ergonomic user format for a portable flushing method. These improvements will have the advantages of providing a simple, lightweight, efficient, inexpensive, easily grasped, operated and controlled, portable recyclable fluid flushing method that can act in lieu of prior art portable flushing methods.

Further objects and advantages of this invention will become apparent from a consideration of the drawings and ensuing descriptions thereof.

DESCRIPTION OF DRAWING FIGURES

REFERENCE NUMERALS IN DRAWINGS

Figure 1:
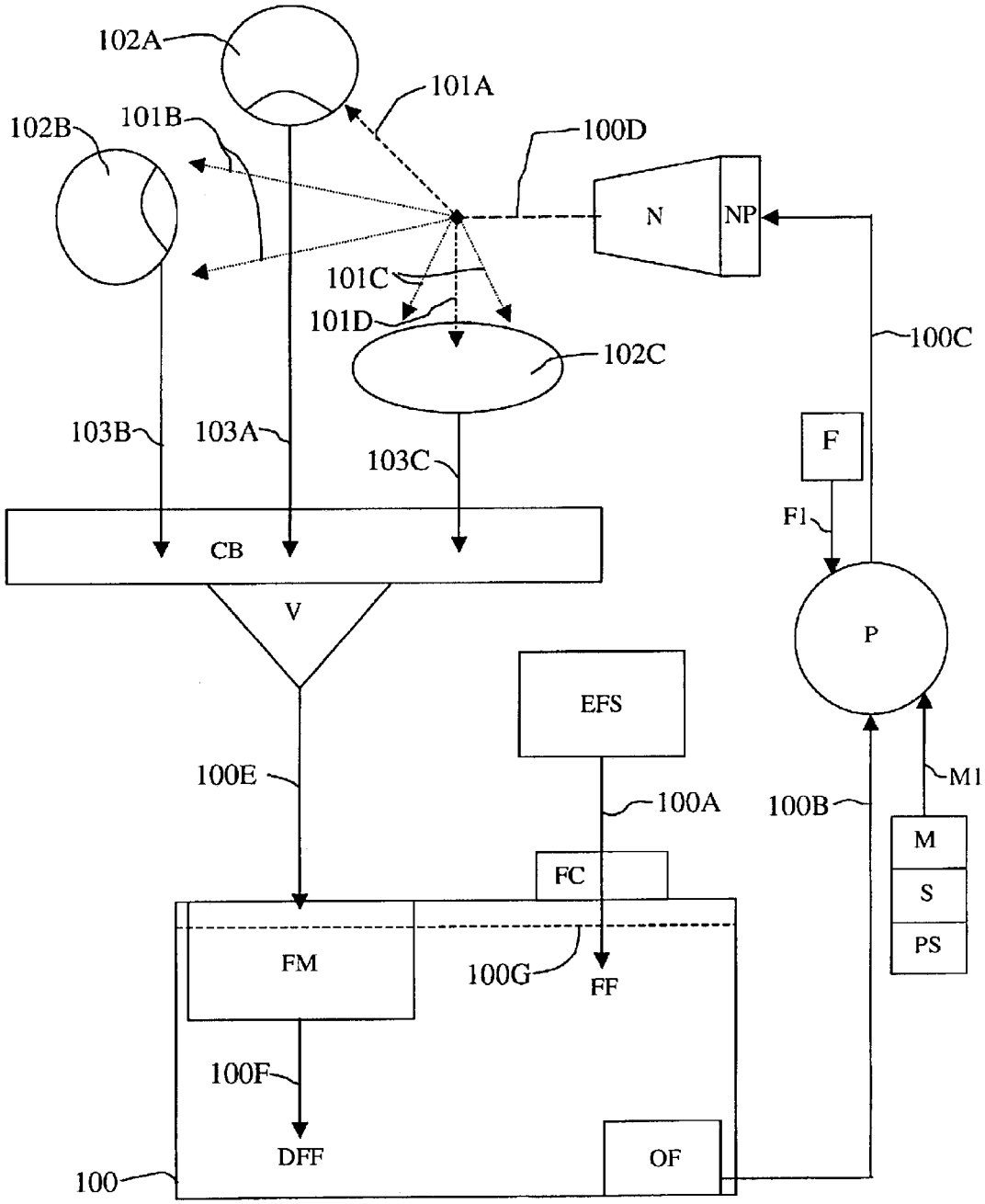
FIG. 1 shows a diagrammatic flowchart of the fluid movement within a portable recyclable fluid flushing system done in the method of the invention.

FIG. 1 Reference Numerals

100=fluid container
100A=fluid flow from external fluid source into container
100B=fluid flow from outflow filter to pump
100C=fluid flow from pump to nozzle
100D=fluid flow into optional settings for nozzle direction and stream type
100E=contaminated fluid stream from flushing run-off
100F=filtered fluid flow into container
100G=fluid fill line within container 100
101A=upward-directed fluid stream
101B=side-directed fluid spray
101C=down-directed fluid spray
101D=down-directed fine point fluid stream
102A=downward-facing eye
102B=forward-facing eye
102C=body part
103A=contaminated fluid stream from 102A
103B=contaminated fluid stream from 102B
103C=contaminated fluid stream from 102C Other Reference Notation Used in FIG. 1

CB=catch basin used for retrieving fluid for recycling through filter
EFS=an external fluid source for container 100
F=manual force applied to a manual pump P
F1=force line from force F to manual pump P
FC=Fill cap for container 100
FF=initial clean flushing fluid
FM=filter media
DFF=decontaminated flushing fluid
M=an electric motor for pump P
Ml=force line of motor M to pump P
N=nozzle
NP=nozzle port
OF=a secondary fluid filter for debris, chemical, etc.
P=fluid pump or impeller
PS=power source for motor M
S=switch
V=a one-way drain valve, FIGS. 2–4 Reference Numerals

200=an eye to be flushed
200A=face of afflicted victim
201=cylindrical container
201A=top portion of cylindrical container
201B=bottom portion of cylindrical container
201C=screw thread connections
201D=rim portion of 201A
201E=drain basin plate
201F=screw-threaded spout
201G=drain hole
202=sterile or clean fluid
202A=fluid spray stream
202B=fluid runoff
203=spray pump
203A=manually depressible, rotatable pump cap
203B=lower pump inlet hose
203C=pump nozzle
203D=rotatable pump screw attachment cap
204=one-way valve
205=drain filter cartridge
205A=valve receptor port
205B=tubular aperture
205C=filter outlet tube FIGS. 5-16A Reference Numerals

300=eye to be flushed
301=cylindrical container
301A=upper rim of 301
301B=inner rim plate
301 C=first rim plate aperture
301E=fluid chamber bottom plate
301F=bracket clasp
301G=fluid chamber bottom plate aperture
301H=aperture for lever L
302=container top cap
302A=sterile fluid stream
302B=contaminated fluid stream
303=threaded side-fill plug
303A=plug turning handle
303B=threaded fluid fill plug hole
304=fluid chamber
305=sterile or clean fluid
306=spray nozzle
306A=nozzle top outlet orifice
306B=nozzle bottom inlet hole
307=pump outlet tube
307A=pump inlet tube
308=filter cartridge
308A=sealed aperture through drain filter cartridge
308B=filter fluid inlet aperture
308C=filter one-way check valve
308D=filter outlet tube
309=fluid impeller pump
309A=impeller pump outlet port
309B=impeller pump inlet port
309C=keyed rotor shaft end
310=pump inlet filter
311=electrical wires
311 A=snap on/off wire connector harness
312=batteries
312A=battery casing
313=on/off switch
313A=switch 313 aperture in wall of 301
314=outer bottom cylindrical housing
314A=housing bottom plate
315=viewing strip
316=cap alignment marker
317=conduit extender block
317A=block inlet channel
317B=block outlet channel
317C=inlet nipple
317D=outlet nipple
318A=cap inlet hole
318B=cap outlet hole
318C=rim inlet hole
318D=rim outlet hole
319=inlet/outlet return member
319A=upper insertion tube

319B=lower insertion tube
319C=storage retainer holes
320A=fluid conduit outlet extension
320B=fluid conduit inlet extension
320C=outlet hose tip
320D=inlet hose tip
321=dual-hose slide member
322=dual-hose inlet-outlet insertion member
322A=upper outlet hole
322B=lower inlet hole
322C=upper outlet tube extension
322D=lower inlet tube extension
323=portable storage container
323A=storage container screw on/off top cap
323B=inverted top cap inlet aperture for basin 324
324=foldably unfoldable portable drain basin
324A=drain basin rim wall
324B=drain basin bottom
324C=rigid circular drain plate
325A–325D=basin drain holes
326=circular plastic hub
326A=hub axle
326B=opposing bottom central hub
327=top cross-support bar
327A, 327B=right-angled endpieces of top cross-support bar
327C, 327D=clockwise arrows for bar 327
328=bottom support bar
328A, 328B=opposing end clips of bottom support bar
328C, 328D=clockwise arrows for bar 328
329=flexibly rigid fluid outlet tube assembly
329A=flexible length portion of 329
329B=right nozzle extension of 329D
329C=left nozzle extension of 329D
329D=rotatable cross tube at end of 329
329E=right eyecup with drain hole
329F=left eyecup with drain hole
330=flexible inlet tubing
330A=rigid insertion tip
331=inlet/outlet member
331A=upper outlet hole
331B=lower inlet hole
331C=upper outlet tube tip
334D=lower inlet tube tip
400=level surface
L=lever
M=motor Description and Operation—FIGS. 1-4—Preferred Embodiment Flowchart FIG. 1 shows a diagrammatic flowchart of the fluid transport system within a portable recyclable fluid flushing system done in the method of the present invention of a portable recyclable fluid flushing method. The primary components of the fluid transport system of the portable recyclable fluid flushing method of the invention as shown in FIG. 1 are well known conventional elements of the related prior arts, and therefore require little detailed explanation.

A plastic or other polymeric material fluid container 100 is filled with an appropriate flushing fluid, represented in the drawing by a boxed-in "FF" (i.e., boxed-in within container 100), typically sterile water or a water-based solution, to a fluid level line 100G from an external fluid supply source, represented in the drawing by a boxed-in "EFS." Fluid travels along a downwardly disposed arrow-line 100A into container 100 when a plastic or other polymeric material, screw on-off or snap on-off or other filler cap, represented in the drawing by a boxed-in "FC," is temporarily removed and then replaced.

Flushing fluid FF enters the fluid transport system of the device typically through an optional one-way, outflow fluid filter, represented in the drawing by a boxed-in "OF," whereafter fluid FF enters into an end of a plastic or other polymeric material tube or other material channel, fluid conduit 100B. Conduit 100B is connected at its opposite end to a sealed fluid pump, represented in the drawing by an encircled "P." Fluid pump P may be a manually operated pump, for example, a spring-operated piston pump, or a hollow, flexible syringe, which requires an operative manual force, represented in the drawing by a boxed-in "F" over a downwardly disposed force arrow-line F1 which terminates at fluid pump P. Or, alternately, fluid pump P may be a different form of manually and/or electrically driven impeller pump, i.e., a rotary type pump, or a reciprocating-piston type pump. Pump P may then be connectively driven by a small rotary shaft electric motor, e.g. by direct axle shaft connection or by connectively interposed mechanical gear transmission linkage, or otherwise driven by a suitable electromotive mechanism such as a solenoid, with each and all such electric motors represented in the drawing by a boxed-in "M" with an upwardly-disposed force line M1 which terminates at fluid pump P. Motor M is shown electrically connected to a suitable on/off or rheostat-type of switch, represented in the drawings by a boxed-in "S" which is shown further electrically connected to an on/off switchable power source, typically conventional or rechargeable batteries, or a manually operated crank or shaker-induction electrical generator power source, represented in the drawing by a boxed-in "PS."When fluid pump P is actuated by a manual force F acting across force line F1, or actuated by motor M acting across force line M1 after switch S connects power source PS to motor M, fluid FF in first fluid conduit 100B flows through fluid pump P into a second fluid conduit 100C and thence into an optional fluid outlet nozzle port, represented in the drawing by a boxed-in "NP." A nozzle, represented in the drawing by a left-facing, trapezoid-enclosed nozzle "N," is typically a fixed or adjustable flow rate, fixed position or attachably detachable, plug-in or screw-in nozzle which fits within a dispersal outlet tube or channel, or in connection with nozzle port NP. If present, optional nozzle port NP is thus utilized for a quick exchange of nozzle types or for the introduction of extendible dispersal tube fluid dispensers with remote nozzles, as explained below.

At this point in the fluid transport system of the invention fluid exits nozzle N along left-facing fluid stream (long-dashed) line 100D in one of several immediately adjustable or predetermined states. Which state stream 100D actually takes will depend upon the angular orientation of nozzle N and its dispersal orifice settings. If an upwardly-angled, single-aperture nozzle N is set to direct an upwardly angled, single fluid stream along (short-dashed) line 101A toward, for example, a downward-facing eye 102A, reflective runoff and spillage will typically fall downward primarily along a downwardly-disposed arrow-line 103A into a catch basin, represented in the drawing by a boxed-in "CB." If a horizontally-angled, multiple-aperture nozzle N is set to direct a set of multiple fluid streams along (dotted) lines 101B into a forward-facing eye 102B, the reflective runoff and spillage will be better captured if catch basin CB is curved or contoured at an edge which can be pressed against the face (not shown) so as to fall downward into the catch basin CB along downwardly-disposed line 103B. If a downwardly disposed nozzle N is utilized with either a set of multiple fluid streams along (dotted) lines 101C, or with a fine point single fluid stream along (dash-dot) line 101D, where the object of the fluid dispersal from nozzle N is to flush a wound in, for example, an appendage 102C, the reflective runoff and spillage into catch basin CB will be downward along arrow-line 103C.

At this point in the flowchart of FIG. 1, uncontaminated fluid has been pumped by pump P from container 100 through the fluid transport system and through dispersal nozzle N into a fluid stream appropriate for the flushing procedure, and has now become contaminated runoff and spillage which is captured within catch basin CB. Contaminated fluid then passes through an optional, conventional one-way check valve, typically an elastomeric duckbill valve or a ball type port valve, all represented in the drawing by a triangularly-enclosed "V," which permits fluid to drain from catch basin CB, but which will not allow any reverse flow of contaminated fluid back into catch basin CB.

Contaminated fluid is then transported through a first drain fluid conduit, represented in the drawing by a downwardly-disposed arrow-line 100E, after which the contaminated fluid passes into a filter cartridge or fluid filtering media, represented in the drawing by a boxed-in "FM." Filtering media FM is typically a sealed fluid filter assembly which is suitably made for purifying the particular type of fluid being used and for filtering out the particular type of contaminant within the fluid being recycled within the portable flushing system of the particular device in use, as will be more properly explained below. Once the contaminated fluid has been decontaminated by filtering media FM, the contaminant-free fluid is suctioned by the subatmospheric (vacuum-generating) action of pump P through a second drain fluid conduit, represented in the drawing by a downwardly disposed arrow-line 100F, into container 100 where it then mixes with the original clean flushing fluid FF as decontaminated filtered fluid, represented in the drawing by a boxed-in "DFF" (also boxed-in by container 100). Other than any fluid lost from runoff and spillage not re-captured into catch basin CB, the fluid level 100G remains generally constant within container 100 as clean fluid available to be recycled again through outflow filter OF as explained above.

In various embodiments of the invention nozzle N and/or nozzle port NP along with drain valve V are adapted to fluid conduit extensions, typically either rigid or continuously flexible tubing, or flexible stay-put tubing, in order to provide a remote extension for fluid dispersal toward and recovery from a remote catch basin for recycling fluid through the fluid transport system illustrated in FIG. 1, as will be better explained below.

The preferred embodiment of FIGS. 2-4, and the alternate embodiment of FIGS. 5–16, as explained below, more or less follow the guidelines for a fluid transport system as set forth in the flowchart of FIG. 1. However the flowchart of FIG. 1 only provides an overall generalization of the fluid flow within the portable recyclable flushing method of the invention. Other equally suitable flow patterns are possible, for example, where the various elements cited above are otherwise positioned or configured to receive, transport or release the fluid flow, or for example, where predetermined channels are formed into the material body of container 100 in lieu of provided tubes.

Manually Operated Embodiment

Figure 2:
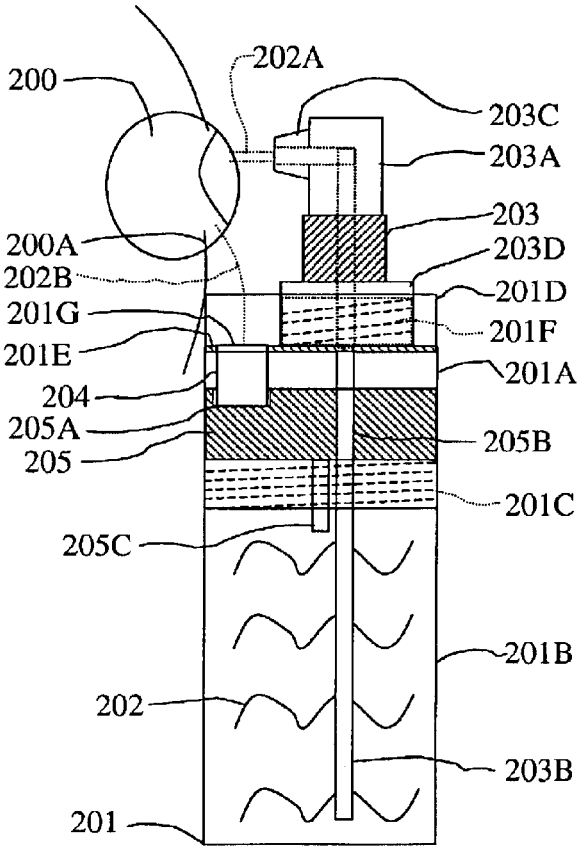
FIG. 2 shows a diagrammatic side view of a preferred manually operated portable recyclable flushing method implementation device.

FIG. 2 shows a diagrammatic side view of a preferred manually-operated portable recyclable flushing method implementation device. FIG. 3 shows a front view of FIG. 2. FIG. 4 shows a top view of FIG. 2. Referring to FIGS. 2-4, the primary object of this particular implementation device of a manually operated portable recyclable flushing method is to utilize a conventional, manually operated spray pump 203 to flush chemical or other irritants from an eye 200 by means of a fluid spray stream 202A whose spillage and runoff 202B is captured and recycled through a suitable filter media within a filter cartridge 205 for flushing reuse via spray pump 203.

The embodiment comprises a two-part plastic or other polymeric material cylindrical container 201 whose top portion 201A is typically attachably detachably screwed onto its bottom portion 201B via a set of conventional screw thread connections 201C formed into the material of container portions 201A, 201B. Typically, the embodiment would have a conventional cylindrical protective thin plastic top cap (not shown) which would be suitably sized to be placed over top portion 201A and removed prior to use.

Prior to use, container bottom 201B is unscrewed and separated from container top 201A, and container bottom 201B is filled with a sterile or otherwise clean flushing fluid 202, typically water or a water-based solution with additives for cleansing the chemical irritant from eye 200. Container top 201A is then re-screwed onto container bottom 201B. Container top 201A may have a neoprene rubber or other material seal (not shown) which is then tightened down onto container bottom 201B. Alternately, container portions 201A, 201B may be formed to be attachably detachably pressure-fitted together.

A conventional plastic or other polymeric material, manually operated, upwardly spring-biased, piston-type, spray pump 203 is made connective with and positioned within container top 201A in the following way. Container top 201A has a thin, upper-encircling annular wall, rim 201D formed into the material of its upper portion. Rim 201D is positioned at a predetermined uniform distance above the horizontal plane of a drain basin plate 201E, also formed into the material of container top 201A. Rim 201D also encircles an upper screw-threaded spout 201F formed into the material of container top 201A which is suitably sized and threaded to receive a pump screw attachment cap 203D which is rotatably connective with a lower portion of spray pump 203. A manually depressible, rotatable pump cap 203A, with a pump nozzle 203C, is further connective with an upper portion of spray pump 203. Nozzle 203C is typically provided with a larger than normal orifice so that a thicker than normal fluid stream is dispersed from spray pump 203. This is done so as to avoid injuring or causing further discomfort to the afflicted victim's eye during the flushing procedure. A downwardly disposed, centrally positioned spray pump lower inlet hose 203B (or tube or other fluid conduit), is also connective with spray pump 203 at its lower end. When inlet hose 203B is properly inserted (as explained below), spray pump 203 is then made connective with container top 201A when rotatable cap 203D is tightly rotated onto threaded spout 201F.

Container top 201A also has a drain hole 201G formed into the material of drain plate 201E. Drain hole 201G is suitably sized to receive a pressure fit, attachably detachable connection with a top portion of a conventional one-way fluid check valve 204, typically an elastomeric duckbill-type or a ball-type port valve. The lower portion of valve 204 is suitably sized to be attachably detachably pressure-fit within a provided plastic or other polymeric material or metal receptor port 205A in a plastic or other polymeric material encased, replaceable filter cartridge 205. Drain filter cartridge 205 is suitably sized and manufactured to fit sufficiently tight within the inside walls of the lower portion of container top 201A so as to seal fluid 202 within container bottom 201B. Drain filter cartridge 205 also has a sealed (encased), vertically disposed, tubular aperture 205B formed near its middle portion and a filter outlet tube 205C formed into or pressure-fit attached to its bottom portion. Aperture 205B is sized to allow for the leakproof insertional passage of lower pump inlet hose 203B (which is also an outlet fluid conduit for the fluid in container bottom 201B). Drain filter cartridge 205 is more properly explained below.

Once container 201 is filled with an appropriate flushing fluid 202 and screwed together as an integral unit as explained above, spray pump lower inlet hose 203B is passed through drain filter cartridge aperture 205B and spray pump 203 is attachably detachably screwed onto spout 201F using rotatable screw cap 203D. Screw cap 203D will typically have a neoprene rubber or other material seal (not shown) which is then tightened down onto spout 201F on container top 201A. The lower portion of spray pump 203, pump inlet hose 203B, is then positioned near to the bottom of bottom container 201B and within fluid 202.

In use, the device is typically grasped by holding fluid container 201 with a preferred hand (not shown) so that a thumb is to one side and the fingers to the other, with an index or other finger placed atop pump head 203A. Cylindrical container top 201A with upper rim 201D is then pushed against the lower portion of the face of the victim person (one's self or another) whose eye 200 is to be flushed so that the curvature of container upper rim 201D rests firmly against the front portion of a cheek 200A and the side of a nose (not shown). Drain hole 201G is typically positioned toward eye 200 with pump nozzle 203C directed at eye 200. Fluid 202 may then be manually pumped by a downward finger pressure exerted against the top of piston-actuating head portion 203A of spray pump 203. The conventional piston spring return of pump 203 (not shown) then restores pump 203 to its next actuable position.

When pump 203 is thus repeatedly finger actuated, fluid 202 is drawn from bottom container 201B through pump inlet tube 203B and passes out of pump 203 via nozzle 203C in the form of a thick fluid spray stream 202A which is directed at eye 200 to flush out chemical irritants and other debris. The manual pressure of rim 201D against the person's cheek and nose creates a seal which causes a stream of contaminated spillage and runoff 202B from fluid spray stream 202A to fall downward into the inside perimeter of rim 201D and form a basin pool within the confines of rim 201D and drain plate 201E. Fluid runoff 202B then passes downward through drain hole 201G and thence through one-way valve 204 and thence into filter cartridge 205. As contaminated fluid 202B flows through drain filter cartridge 205 it becomes contaminant-free fluid which is pulled by vacuum pump action through filter outlet tube 205C into container bottom 201B where it mixes with flushing fluid 202 and is then recycled through pump suction tube 203B during a repeat of the pumping procedure just explained above.

When the eye-flushing process is completed, the manual pumping process is stopped and the device is either properly disposed of or decontaminated with appropriate cleaning fluids for future use. At this time drain filter cartridge 205 may be visually or otherwise checked for remaining life use (as will be later explained) and either retained or replaced. Typically, a protective flip top cap or push-on pull-off cap (not shown) with an attached string or other form of retainer is utilized with the device. The device is then typically stored in a suitable place where it will be accessible for immediate use in the event of another person being affected by a chemical or other irritant in the eyes, e.g., left in a work station area or clipped onto a police officer's belt rig with a provided clip (not shown), or otherwise placed within a suitably sized carrying pouch (not shown).

Alternately, spray pump 203 may be replaced with an electrically driven pump as was explained in terms of the flowchart of FIG. 1 and as will be further explained in terms of the alternate embodiment explained further below. And, alternately, if preferred, drain filter cartridge 205 may be of a size, shape and type which can be placed directly in line with pump inlet hose 203B near to the bottom of bottom container 201B and within fluid 202 as was explained in terms of the flowchart of FIG. 1 and as will be further explained in terms of the alternate embodiment explained further below.

Drain Filter Cartridge 205

Figure 3:
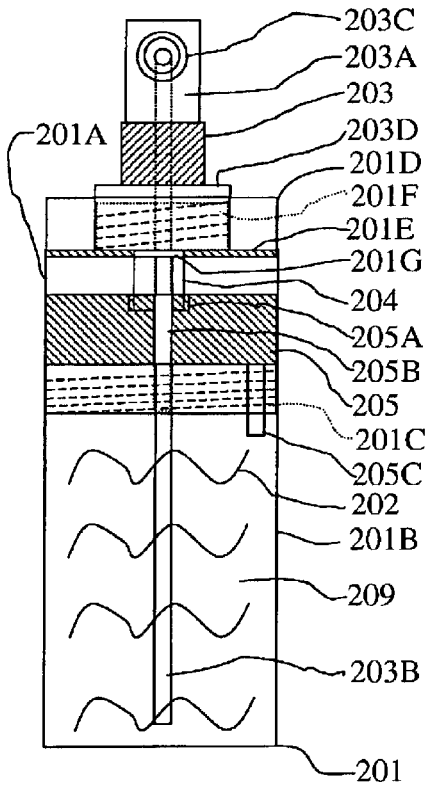
FIG. 3 shows a front view of the device of FIG. 2.
Figure 4:
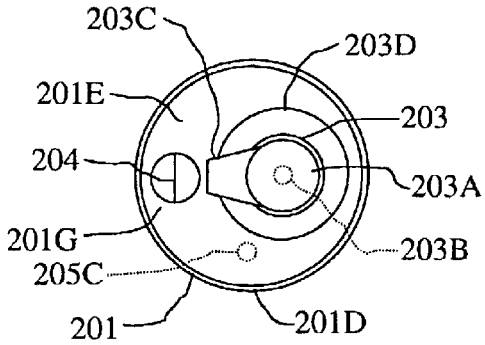
FIG. 4 shows a top view of the device of FIG. 2.

Drain filter cartridge 205 is shown in FIGS. 2, 3 as a truncated cylinder, but may be of any suitable shape or size or type, and have a variety of other flowthrough configurations to suit the particular filtering purposes of the portable recyclable flushing device manufactured. Since drain filter cartridge 205 is primarily intended for use with the filtration of fluids contaminated by the oily glue-like resin of by Oleoresin Capsicum (liquid pepper), or tear gas, or Mace™, or other chemical agents which are difficult to flush from the eyes, drain filter cartridge 205 will be most effective as a multi-layered filtration system designed to remove both the aforementioned oily resin and other present chemical agents. Of course, the size and type of drain filter cartridge used will vary depending upon what is needed to be removed from the water. In order to remove organic contaminants down to the size of cholera it is necessary to use a filter with a 0.5 micron pore size or smaller.

Mycelx™ filters may be utilized to immediately remove the entire range of organic compounds from water. Mycelx™ filters, based on U.S. Pat. No. 5,437,793, Coagulant for Oil Glyceride/isobutyl Methacrylate Composition and Method of Use, Aug. 1, 1995, and U.S. Pat. No. 6,180,010 B1, Removal of Organic Contaminants From an Aqueous Phase Using Filtration Media Infused with an Absorbent Composition, Jan. 30, 2001, both to Hal Alper, are available from Mycelx Technologies Corp., Gainesville, Ga. Drain filter cartridge 205 would then ideally be a multi-layered or multistage filter assembly incorporating Mycelx™ or a similar oil-removing filter media, along with a secondary filter employing activated charcoal in granular or block form, or Powder Activated Coconut Carbon (PAC), which is considered to be the highest quality and smallest of the carbon medias. Conceivably, Bio-Shield™, which is a commonly sold blend of herbal ingredients which neutralizes both tear gas (irritant) and pepper gas (inflammatory) chemical agents, might also be utilized in a drain filter cartridge in the device. Further, glass wool, synthetic fiber materials, chemical filtering materials and any other materials used to fabricate filters may be employed as filtering material. Or for example, the device may be made in several layers with a planar fiberglass prefilter over a planar permeable submicron filter media. Or, for example, filters used to filter blood may be used, or a commercially available BacStop™ in-line sterilizing filter for ophthalmic irrigating solutions may be used. Other alternative filter media and cartridge types will be apparent to those skilled in the art.

Drain filter cartridge 205 may then be disposed of and replaced when it reaches its life's end (becomes neutralized or clogged). Alternately, other fluid conduit transport connections could be made in regards to drain filter cartridge 205 to make it possible to backwash drain filter cartridge 205 rather than disposing of and replacing it. And, alternately, drain filter cartridge 205 could be replaced entirely by a suitable, equivalently functioning pump inlet filter cartridge provided at the inlet point of outlet tube 203B. Alternately, drain filter cartridge 205 could be provided with a Hydrocarbon sensor, or with a fluid filter color indicator such as is described in U.S. Pat. No. 3,841,484, Fluid Filter with Color Indicator, to Keith Domnick, Oct. 15, 1974, to indicate (via a provided clear viewing portion in container 201) when the filter media in cartridge 205 is near its useful life's end.

Description and Operation—FIGS. 5-16A—Alternate Embodiment

Figure 5:
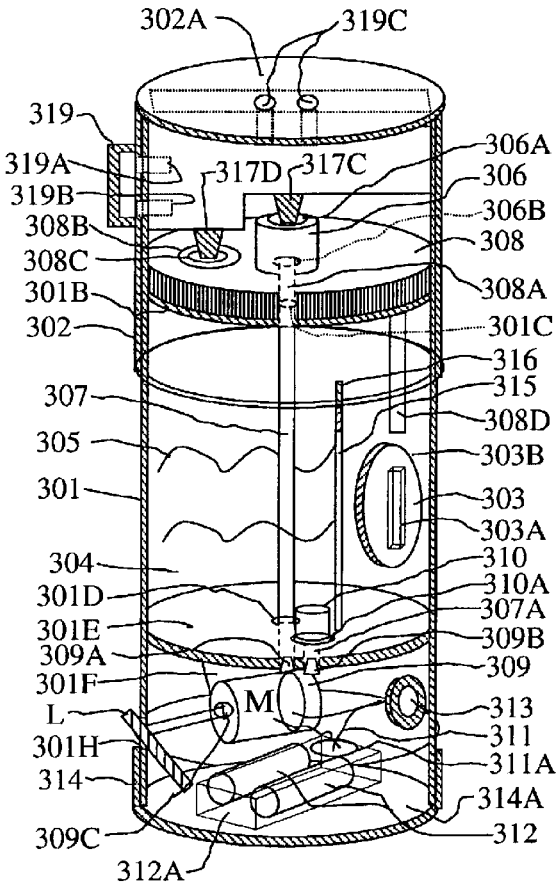
FIG. 5 shows a diagrammatic perspective view of an alternate electrically operated portable recyclable flushing method implementation device.
Figure 6:
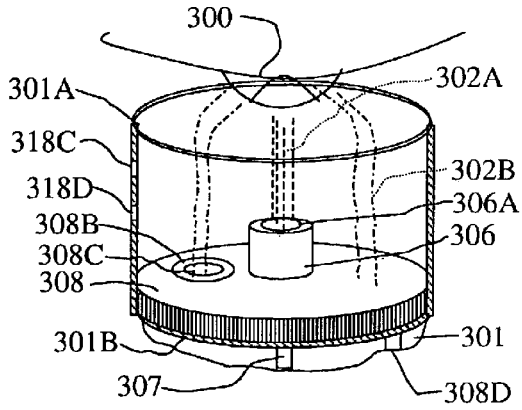
FIG. 6 shows a diagrammatic cutaway view of the device of FIG. 5 with the top cap removed.
Figure 7:
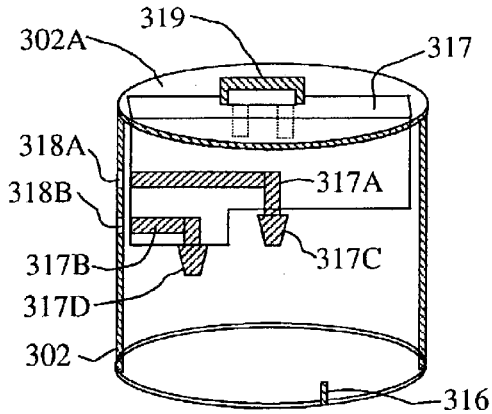
FIG. 7 shows a diagrammatic cutaway view of the cap for the device of FIG. 5.
Figure 8:
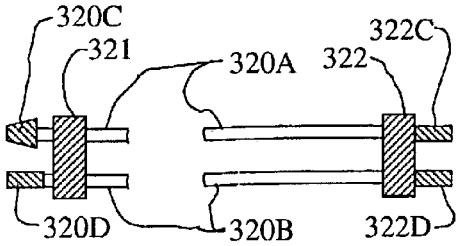
FIG. 8 shows a cutaway side view of both ends of a flexible dual-hose fluid conduit extension system for the device of FIG. 5.

FIG. 5 shows a diagrammatic perspective view of a preferred alternate, electrically operated, portable recyclable flushing method implementation device. FIG. 6 shows a diagrammatic cutaway view of the device of FIG. 5 with the top cap removed. FIG. 7 shows a diagrammatic cutaway view of the top cap for the device of FIG. 5. Referring to FIGS. 5, 6, one of the primary objects of this implementation device of an electrically operated portable recyclable flushing method is to utilize a fluid container 301 with an electrically operated fluid impeller pump 309 to flush chemical or other irritants from a downward facing eye 300 by means of an up-directed fluid spray stream 302A whose spillage and runoff 302B is captured and recycled through a drain filter cartridge 308 for flushing reuse via spray nozzle 306. Another primary object of this alternate implementation device is to utilize an electrically operated fluid impeller pump 309 to flush chemical or other irritants from various body parts (not shown) via a flexible fluid conduit outlet extension 320A and a flexible fluid inlet extension 320B used in conjunction with top cap 302, so that the device may be further used in combination with a foldably unfoldable drain basin system which will be later explained below in terms of FIGS. 5-14.

Description of Eye-flushing Components

The alternate embodiment of FIGS. 5-7 comprises a plastic or other polymeric material cylindrical container 301 whose top portion is a pull-off push-on, attachably detachably pressure-fit cap 302. Cap 302 also serves as a protective cap to keep the device in a sanitary condition, and serves as well as an alternate fluid dispersal system which will be later explained below. The cylindrical wall of container 301 has a thickened portion approximately midway down its vertical length into which a threaded fluid fill plug hole 303B has been formed to allow for the introduction of a suitably sized, threaded plastic or other polymeric material, side-fill plug 303 with a formed-in turning handle 303A. Prior to use, side plug 303 is unscrewed via turning handle 303A and temporarily separated from container 301 so that a fluid chamber 304 within container 301 may be filled with a sterile or otherwise clean flushing fluid 305, typically water or a water-based solution with additives for cleansing chemical irritants from an eye 300, or other solutions for other flushing procedures as will be explained further below. Plug 303 is then re-screwed into fill plug hole 303B to form a tight seal of fluid 305 within fluid chamber 304. Plug 303 may have a neoprene rubber washer or other material seal (not shown) to assist in fluid loss prevention. Alternately, plug 303 may be a simple rubber-type plug, or, alternately, container 301 may be formed in two parts with connective screw threads, or may be attachably detachably pressure-fitted together at its fluid chamber portion 304 for an alternate fluid filling.

When cap 302 is removed and apart from container 301 (as shown in FIG. 7), the top of container 301 appears as shown in the cutaway diagram of FIG. 6 where a plastic or other polymeric material fluid dispersal nozzle 306 with a suitably sized orifice 306A is approximately centered within an annular high-walled, uniform rim 301A which is formed from the upward portion of container 301. Nozzle 306 is typically provided with a larger than normal orifice 306A so that a thicker than normal fluid stream is dispersed from pump 309. This is done so as to avoid injuring or causing further discomfort to the afflicted victim's eye during an eye flushing procedure.

Referring to FIGS. 5, 6, nozzle 306 has a suitably sized inlet hole 306B on its underside which is pressure-fitted onto the top of a plastic or other polymeric material pump outlet tube 307. Tube 307 or conduit is a vertically disposed tube which passed downwardly through a sealed aperture 308A within a drain filter cartridge 308 and a first rim plate aperture 301C within an inner rim plate 301B. Inner rim plate 301B is a right-angled, circular plate formed from the material of container 301 within its inside wall.

Drain filter cartridge 308 has an inlet aperture 308B which contains a conventional one-way check valve 308C, typically an elastomeric duckbill or ball type port valve. Drain filter cartridge 308 also has a downwardly disposed outlet tube 308D. Drain filter cartridge 308 and its indicated components are better explained below.

Tube 307 extends downward through a suitably sized aperture 301D in a fluid chamber bottom plate 301E which is also a right-angled, circular plate formed from the material of container 301 within its inside wall. Tube 307 terminates with a pressure-fit connection onto an outlet port 309A of a motor-driven fluid impeller pump 309 which is made as a sealed unit within an integral casing with a small DC (direct current) electric motor, represented in the drawing by an "M" enclosed by a horizontal cylinder. Motor M with impeller pump 309 is mounted to the underside of chamber bottom plate 301E by a suitably sized wrap-around plastic or other polymeric material or metal bracket clasp 301F which is formed into or suitably fastened to the underside material of plate 301E.

A vertically disposed, short plastic or other polymeric material inlet tube 307A is held in position by a pressure-fit attachment with a suitably sized inlet port 309B of impeller pump 309. The top of inlet tube 307A (which is also an outlet fluid conduit for the fluid in chamber 304) is pressure-fit into a bottom aperture (not shown) within an optional cylindrical or otherwise shaped pump inlet filter 310. Inlet filter 310 has a bottom neoprene rubber or other appropriate material circular sealing flap 310A with a suitably sized aperture (not shown) to allow inlet tube 307A to pass through into filter 310. Fluid chamber bottom plate 301E has a suitably sized aperture 301G (not shown; filled by filter 310) which allows filter 310 to pass upward and be sealed at its bottom (beneath plate 301E) by flap 310A when pressed upward by its connection with tube 307A.

Motor M is electrically connected via three wires 311 to conventional or rechargeable batteries 312 and to a threaded or pressure-fit, on-off electrical switch 313 mounted through a provided plain or threaded aperture 313A (not shown; filled by switch 313) in the outer wall of container 301. Switch 313 is typically a press-on, press-off switch, but may be any other suitable momentary, rheostat, or on-off switch. Batteries 312 are typically enclosed within a battery casing 312A which is attachably detachably, snap on-off connected to a conventional snap on-off wire electrical connector harness 311A for wires 311. Battery case 312A is then attachably detachably snap in-out connected to the bottom plate 314A of a slide-removable outer bottom cylindrical housing 314 which fits tightly over the open bottom of container 301. Alternately, a magnetic induction recharging system may be utilized for batteries 312.

Alternately, in lieu of or in addition to motor M and its associated electrically related components, a manually operated impeller pump system may be utilized to actuate the fluid transport system of the device. Referring to FIG. 5, a manually-rotatable plastic lever L is shown with a protruding key shaft which passes through a provided aperture 301H in the outer wall of container 301 and connects directly to a key slot 309C on an exposed rotor shaft end of motor M. In an emergency where batteries 312 have failed to operate pump 309, lever L is removed from a storage location within slide-removable outer bottom cylindrical housing 314 and inserted through aperture 301H until it is keyed into position within keyed slot 309C. Lever L is then finger twirled to operate the rotor shaft via slot 309C and thus operate impeller pump 309. In addition to or in lieu of Motor M and/or lever L, the alternate portable flushing device of FIG. 5 may be provided with any other suitable form of manually-operated pump for the fluid transport system.

A vertically disposed, transparent or translucent viewing strip 315 is typically formed into the material of container 301 or is added in as a suitably connected separate plastic or other polymeric material member. Viewing strip 315 is used to visually determine the amount of fluid 305 remaining in fluid chamber 304 (that, is the amount of recovered, recyclable fluid not lost to spillage outside the overall fluid transport system). The top portion of viewing strip 315 is typically given a color or pattern to permit its use as a marker indicia for further alignment of top cap 302, as will be explained below. The alternate device is then typically stored in a suitable place where it will be accessible for immediate use, e.g., left in a work station area or clipped onto a police officer's belt rig with a provided clip (not shown), or otherwise placed within a suitably sized carrying pouch (not shown).

Drain Filter Cartridge 308

Drain filter cartridge 308 is shown in FIGS. 5, 6 as a truncated cylinder, but may be of any suitable shape or size or type, and have a variety of other flowthrough configurations to suit the particular filtering purposes of the portable recyclable flushing device manufactured. Since drain filter cartridge 308 is primarily intended for use with the filtration of fluids contaminated by various chemical or infectious agents that may be difficult to flush from the eyes, skin or open wounds, drain filter cartridge 308 will be most effective as a multi-layered filtration system designed to remove both oily resins, if present, and other possibly present chemical agents. Of course, the size and type of drain filter cartridge used will vary depending upon what is needed to be removed from the water. In order to remove organic contaminants down to the size of cholera it is necessary to use a filter with a 0.5 micron pore size or smaller.

Drain filter cartridge 308 would then ideally be a multi-layered or multistage filter assembly incorporating Mycelx™ (as previously cited and explained) or similar oil-removing filters along with a secondary filter employing activated charcoal in granular or block form, or Powder Activated Coconut Carbon (PAC), which is considered to be the highest quality and smallest of the carbon medias. Further, glass wool, synthetic fiber materials, chemical filtering materials and any other materials used to fabricate filters may be employed as filtering material. Or for example, the device may be made in several layers with a planar fiberglass prefilter over a planar permeable submicron filter media. Or, for example, filters used to filter blood may be used, or a commercially available BacStop™ in-line sterilizing filter for ophthalmic irrigating solutions may be used. Other alternative filter media and cartridge types will be apparent to those skilled in the art.

Drain filter cartridge 308 may then be disposed of and replaced when it reaches its life's end (becomes clogged). Alternately, other fluid transport connections could be made in regards to drain filter cartridge 308 to make it possible to backwash drain filter cartridge 308 rather than disposing of and replacing it. And alternately, drain filter cartridge 308 could be replaced entirely by a suitable, equivalently functioning outflow filter 310. Alternately, drain filter cartridge 308 could be provided with a Hydrocarbon sensor or a fluid filter color indicator, such as was previously described, to indicate (via a provided clear viewing portion in container 301) when the filter media is near its useful life's end.

Operation as an Eye-flushing Device

Referring to FIGS. 5, 6, prior to using the device, side plug 303 is unscrewed via turning handle 303A and temporarily separated from container 301 so that fluid chamber 304 may be filled with a sterile or clean flushing fluid 305, typically water or a water-based solution. Plug 303 is then re-screwed into container 301 to form a tight seal of fluid 305 within fluid chamber 304. When the device is to be used for flushing an eye 300, the device is held vertically in front of the victim's face. The victim's head is then tipped forward so that the affected eye 300 may be centrally positioned over rim wall 301A, which is then pushed upward until it touches against the victim's face. The victim or a second-party user then manually actuates on/off switch 313 to connect it to battery power source 312 via wires 311 which then actuates motor M and impeller pump 309. Fluid 305 within chamber 304 is then drawn downward through inlet filter 310 through pump 309 and is impelled upward through outlet tube 307 and through nozzle orifice 306A where it becomes a continuous spray stream 302A which flushes affected eye 300. Falling spillage 302B is then collected within rim 301A on the surface of drain filter cartridge 308 which then acts as a drain basin plate allowing spillage fluid 302B to fall through drain aperture 308B and one-way check valve 308C and thence through drain filter cartridge 308. The filtered fluid then travels downward through drain filter cartridge outlet tube 308D (both due to gravity feed action and the suction action caused within the fluid transport system itself) where it then intermixes with fluid 305 in chamber 304 for reuse within the fluid pumping system. During the flushing process, viewing strip 315 is visually monitored to insure that a sufficient amount of fluid is present in chamber 304 to maintain the flushing cycle. When the eye-flushing process is completed, switch 313 is de-actuated and the pumping process stopped. The device is then either decontaminated with appropriate cleaning fluids for future use. At this time drain filter cartridge 308 will be visually checked for remaining life use (as was explained above) and either retained or replaced. Protective top cap 302 is then replaced as explained below.

Description and Operation of Top Cap 302

Referring to FIGS. 5-7, when the alternate device is not in operation, top cap 302 is positioned over top rim 301A in a push-on/pull-off relationship. Prior to installing cap 302 onto rim 301A, cap 302 is visually aligned with container 301 through the use of a cap alignment marker 316 which is then aligned with the marked top of view strip 315 on container 301. Alternately, in addition to or in lieu of alignment indicia, container 301 and cap 302 may be provided with one or more slide channels to assure proper connection of one to the other.

Once cap 302 is properly aligned and installed over rim 301A, various components within cap 302 may be operably interconnected with various components of container 301. Plastic cap 302 is molded with a diametrically centralized, transverse, fluid conduit extender block 317. Block 317 is internally molded to contain two parallel, transverse, fluid conduit channels, an outlet channel 317A and an inlet channel 317B. Channels 317A and 317B respectively have a right-angled portion which is downwardly disposed and which respectively terminate in a molded-in nipple portion, an outlet nipple 317C, and an inlet nipple 317D. Inlet nipple 317D is suitably sized so that it may sealably mate with valve 308C within filter-drain inlet 308B. Outlet nipple 317C is suitably sized so that it may sealably mate with the outlet orifice 306A of nozzle 306.

Referring to FIG. 7, cap 302 has a set of molded holes, a cap outlet hole 318A and a cap inlet hole 318B, which are sized and spaced to be diametrically equivalent to and aligned with the respective transverse end portion apertures of channels 317A and 317B. Rim 301A also has a set of molded holes, a rim outlet hole 318C, and a rim inlet hole 318D, which are sized and spaced to be diametrically equivalent to and aligned with the respective transverse end portion apertures of channels 317A and 317B. Block 317 is itself suitably length sized and provided with curved ends so that when cap 302 is pushed onto rim 301A, rim 301A will slidably engage the inner wall of cap 302 and the outer ends of block 317. When cap 302 is engaged properly with rim 301A using the alignment indicia markers of view strip 315 and marker 316, the respective transverse end portion apertures of channels 317A and 317B will slidably engage rim 301A so that cap holes 318A, 318B will align with rim outlet hole 318C and rim inlet hole 318D. Thus, when cap 302 is properly alignably installed on rim 301A, a through passage exists between the outside of cap 302 through rim 301A into channels 317A, 317B through the two sets of holes 318A, 318B and 318C, 318D.

When cap 302 is thus installed on rim 301A and the fluid transport system of the device is activated as previously explained by switching on switch 313, fluid 305 will begin flowing from nozzle orifice 306A and a suction action will begin at the end opening of filter outlet tube 308D. Fluid 305 will then flow out of nozzle orifice 306A through nipple 317C and out of block channel 317A and a suction action will begin in cap inlet channel 317B. In order to prevent fluid 305 from escaping the fluid transport system, a right-angled U-shaped inlet/outlet return member 319 with a set of protruding insertion tubes, an upper tube 319A and a lower tube 319B, is provided for insertion through cap holes 318A, 318B and thence through rim holes 318C, 318D, terminating in channels 317A, 317B, so that fluid 305 will flow through block outlet channel 317A and follow a return path through return member 319 and flow back into the fluid transport system through block channel 317B. Inlet/outlet return member 319 is typically molded from clear plastic or other polymeric material with its two extension tubes 319A, 319B suitably sized and spaced to fit snugly within the end apertures of channels 317A, 317B. When inlet/outlet return member 319 is not required in the fluid transport system, as will be explained below, it is pulled free from channels 317A, 317B and extension tubes 319A, 319B are pushed facing downward into a set of suitably sized and spaced storage retainer holes 319C which are molded through a cap top piece 302A and on into cap block 317.

Description and Operation of Flexible Fluid Conduit Extension System

Figure 9:
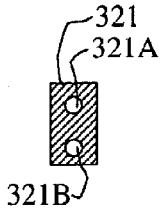
FIG. 9 shows a front view of the dual-hose slide piece of the flexible dual-hose system for the device of FIG. 5.
Figure 10:
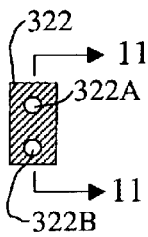
FIG. 10 shows a rear view of the dual-hose inlet-outlet insertion member of the device of FIG. 5.
Figure 11:
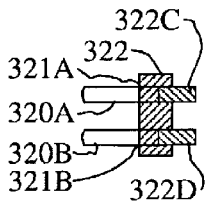
FIG. 11 shows a cross section view of the dual-hose inlet-outlet insertion member of the flexible dual-hose system for the device of FIG. 5 taken along lines 11-11 of FIG. 10.

Referring to FIGS. 8-11, FIG. 8 shows a cutaway side view of both ends of a flexible dual-hose fluid conduit extension system for the device of FIG. 5. FIG. 9 shows a front view of a dual-hose slide member 321 of the flexible dual-hose system for the device of FIG. 5. FIG. 10 shows a rear view of a dual-hose inlet-outlet insertion member 322 of the device of FIG. 5. FIG. 11 shows a cross section view of the dual-hose insertion member 322 of the flexible dual-hose system for the device of FIG. 5 taken along lines 11—11 of FIG. 10. The flexible dual-hose system of FIG. 8 comprises: a. a set of two neoprene or other material, flexible extension tubes of a predetermined length, an outlet extension tube 320A, and an inlet extension tube 320B. Inlet tube 320B is pressure-fit connected at one of its respective ends to a rigid, hollow plastic or other polymeric material, tube tip, an inlet hose tip 320D. Outlet tube 320A is pressure-fit connected at one of its respective ends to a rigid, hollow plastic or other polymeric material, rotatably adjustable tube tip nozzle 320C; b. a rigid plastic or other polymeric material dual-hose insertion member 322 which pressure-fit receives the non-tipped ends of extension tubes 320A, 320B; and, c. a rigid plastic or other polymeric material slide member 321 for slidably separating or drawing together tubes 320A, 320B.

Slide member 321, as shown in a front view in FIG. 9, is typically a solid plastic or other polymeric material box-shaped member with two vertically disposed apertures spaced a predetermined distance apart, an upper outlet aperture 321A, and a lower inlet aperture 321B, respectively sized to slidably accept the outside diameter of outlet hose 320A and inlet hose 320B, but prohibiting the slightly larger sized nozzle 320C and hose tip 320D from passage. Dual-hose insertion member 322, as shown in a rear view in FIG. 10 and in side cross section view in FIG. 11, is typically a solid plastic or other polymeric material box-shaped member with two vertically disposed apertures spaced a predetermined distance apart, and typically at the same distance as holes 321A, 321B in slide member 321. Insertion member 322 has a set of partial holes in its rear portion, an upper outlet hole 322A, and a lower inlet hole 322B, both of which are equivalent to the outside diameter of hoses 320A, 320B to allow a snug fit. When entered into rear holes 322A, 322B, the non-tipped ends of hoses 320A, 320B are stopped at a predetermined distance into insertion member 322 by a molded-in set of rigid, hollow plastic or other polymeric material tubes, an upper outlet tube extension 322C, and a lower inlet tube extension 322D, which are respectively sized to slide tightly into outlet and inlet channels 317A, 317B within cap 302.

As thus far explained, top cap 302 along with flexible dual-hose system 320 serves as a fluid conduit extension to the fluid transport system so that whenever insertion member 322 is inserted, i.e., plugged into, fluid channels 317A, 317B in cap 302, a potential fluid conduit exists for fluid 305 to pass from container 301 into outlet hose 320A and back through inlet hose 320B.

Portable Storage Container and Contents

Figure 12:
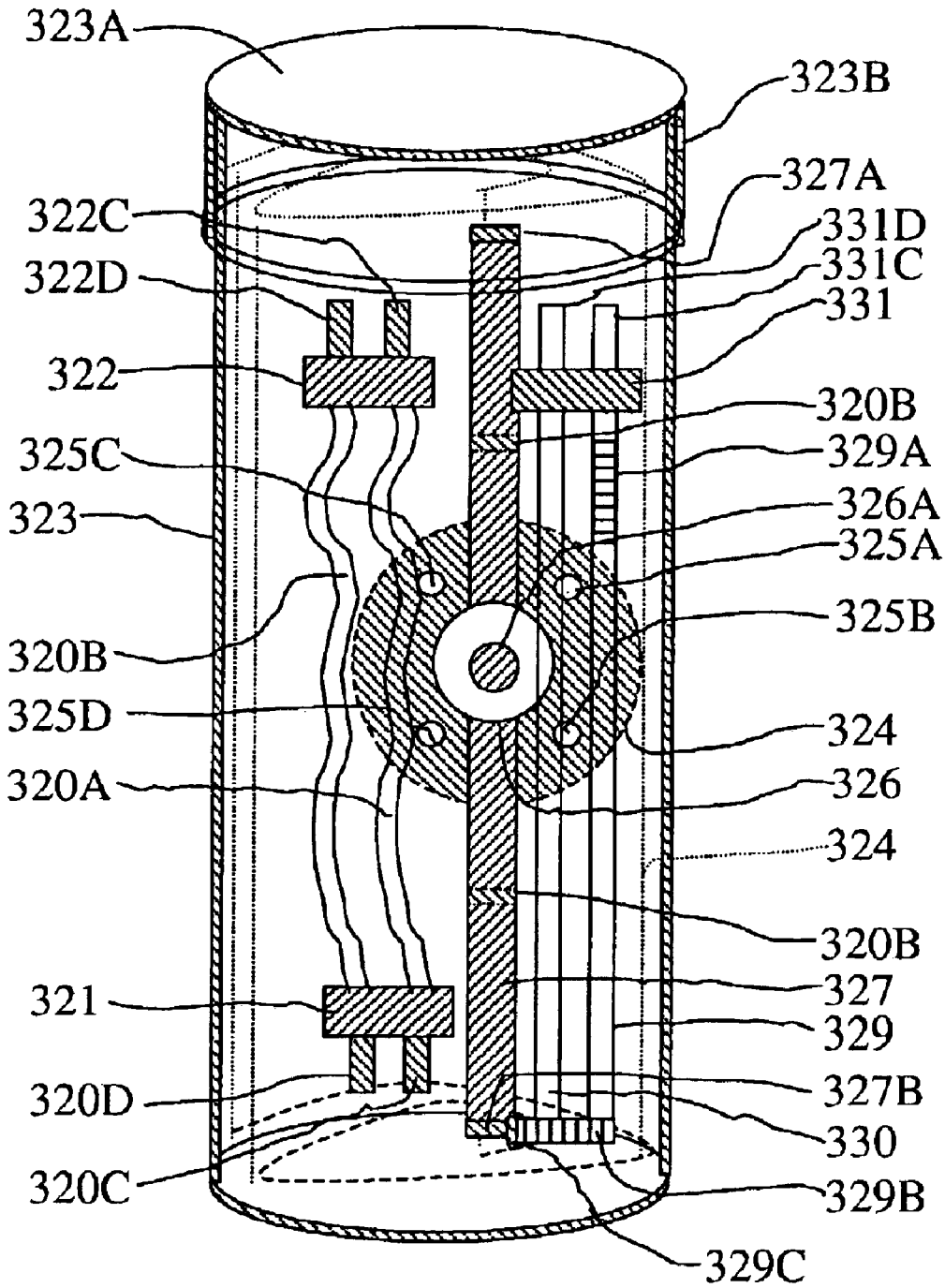
FIG. 12 shows a portable storage container for housing a foldable portable basin and other fluid conduit extension components for the device of FIG. 5.
Figure 13:
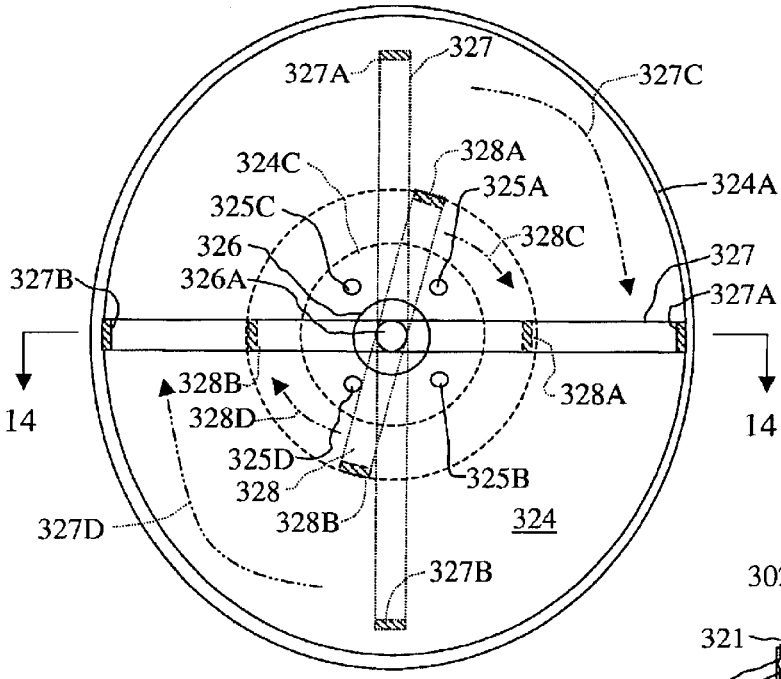
FIG. 13 shows a top view of a foldable portable basin for the device of FIG. 5.
Figure 14:
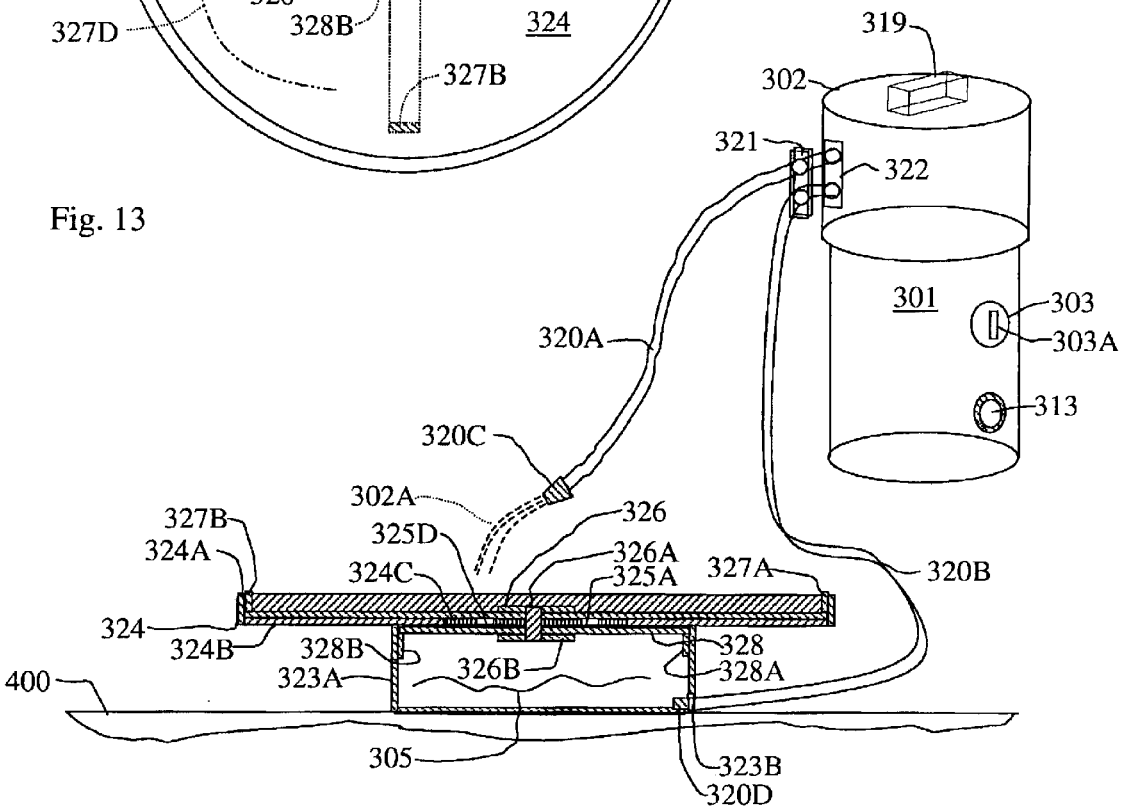
FIG. 14 shows a cross section view of the foldable portable basin for the device of FIG. 5 taken along lines 14—14 of FIG. 13 with the flexible dual-hose system being utilized with the portable basin.

Referring to FIGS. 12-14, FIG. 12 shows a portable storage container 323 for housing a foldably unfoldable portable basin 324 and other fluid conduit extension components for the device of FIG. 5. FIG. 13 shows a top view of foldably unfoldable portable basin 324 for the device of FIG. 5. FIG. 14 shows a cross section view of the (unfolded and rigidified) foldable portable basin 324 for the device of FIG. 5 taken along lines 14—14 of FIG. 13 with the flexible dual-hose system just explained being utilized with the portable basin.

The portable storage container 323 shown in FIG. 12 is typically a cylindrical, rigid plastic or other polymeric material container utilized to store various fluid conduit extension components associated with the alternate portable flushing device of FIG. 5. The components which are stored therein are used primarily to convert the alternate portable flushing device of FIG. 5 into a portable, electrically operated pumping and filtering station for the remote use of the flexible dual-hose fluid conduit system explained above. By using the alternate device of FIG. 5 in operational interconnection with a portable drain basin such as basin 324 it becomes possible to flush chemicals or other debris from various body parts such as a hand or arm (not shown), or to irrigate a wound, as will be better explained below.

Referring to FIGS. 12-14, storage container 323 has a rigid plastic or other polymeric material push-on/pull off, or, alternately, a screw on/off top cap 323A which when removed serves as the base for foldably unfoldable drain basin 324 when cap 323A is inverted and placed on a level surface 400. Drain basin 324 is typically made of a double layered pliable plastic or other polymeric material, or other waterproof material which is formed into a circular or oval shape with a flexible end rim wall 324A. One layer of a drain basin bottom 324B covers the top of a rigid circular drain plate 324C, and an opposing layer covers the bottom of rigid plate 324C. Drain plate 324C and the opposing basin bottom layers are provided with a plurality of suitably sized and spaced drain holes, for example, the four holes shown, 325A—325D, which will allow spillage and runoff to drain into inverted cap-base 323A.

In the center of basin 324 is a circular plastic or other polymeric material hub 326 with an axle 326A which passes through suitably sized apertures in several successively stacked components being: a. a rotatable, rigid plastic or other polymeric material, top cross-support bar 327 with a set of opposing right-angled end pieces, 327A and 327B; b. central bottom portion 324B of basin 324 containing circular drain plate 324C; c. a rotatable rigid plastic or other polymeric material bottom support bar 328 with opposing right angle rim clips 328A and 328B for capturing the inside rim of inverted cap 323A in a pressure-fit which supports basin bottom 324B. Axle 326A of central hub 326 is pressure-fit into a hollow axle portion (not shown) of an opposing bottom central hub 326B to secure the listed components together in a rotatable relationship with hub axle 326A.

When basin 324 is removed from container 323 and unfolded, the user rigidifies the pliable basin material by first rotating cross support bar 327 on axle 326A (as indicated by a set of clockwise arrows 327C, 327D) until its upward-facing, right-angled endpieces 327A, 327B are in a firm pressure-fit within basin rim 324A. Since the material of basin 324 is set to fold inward, cross-support bar 327 holds the material flat against its tendency to fold. The user next rotates bottom support bar 328 with downward-facing, opposing right-angled rim clips 328A and 328B on axle 326A (as indicated by a set of clockwise arrows 328C, 328D) until clips 328A, 328B are in a congruent position beneath top support bar 327. Although it is not necessary to rotate bar 328 to capture inverted cap-base 323A, doing so offers further support to keep basin 323 properly unfolded.

Once bars 327, 328 are in position and inverted cap 323A has been properly set over bottom bar end clips 328A, 328B, the user holds dual-hose nozzle 320C and hose tip 320D while pushing slide member 321 to a desired distance back toward insertion member 322. This action allows tubes 320A, 320B to be separated so that outlet tube 320A with rotatably adjustable nozzle 320C is free to be directed by the user, and so that inlet tube 320B may have its tip 320D inserted into inverted cap 323A inlet aperture 323B. Rotatably adjustable nozzle 320C is a conventional type of nozzle which rotates on a threaded base toward or away from a central stem positioned to engage the fluid flow through it. This permits nozzle 320C to be adjusted from a fine point spray to a thick fluid stream as dependent upon the flushing procedure required. Alternately, cap 323A may be provided with an outflow filter at inlet aperture 323B.

Once, tubes 320A, 320B have been sufficiently separated, the user will next plug insertion member 322 into container 301 top cap 302 and on into outlet and inlet channels 317A, 317B as previously explained. This in effect produces an extended remote flushing system wherein outlet flushing hose 320A with nozzle 320C may be directed over a body part, for example, a hand or arm (not shown) affected by chemical agents, and thereby flush the chemical from the hand or arm as the spillage and runoff falls into basin 324 and falls through drain holes 325A-325D in rigid circular drain plate 324C. Fluid 305 then collects at the bottom of inverted cap 323A where the suction action of inlet hose 320B carries fluid 305 back through the fluid transport system within container 301 as previously explained.

When insertion member 322 is no longer required in the fluid transport system, it is pulled free from channels 317A, 317B and inlet/outlet return member 319 is restored to cap 302 as was previously explained. The flexible fluid conduit extension system may then stored on the side for later decontamination after which it may again be stored in storage container 323 (as shown in FIG. 12).

Description and Operation of Flexibly Rigid Fluid Conduit Extension System

Figure 15:
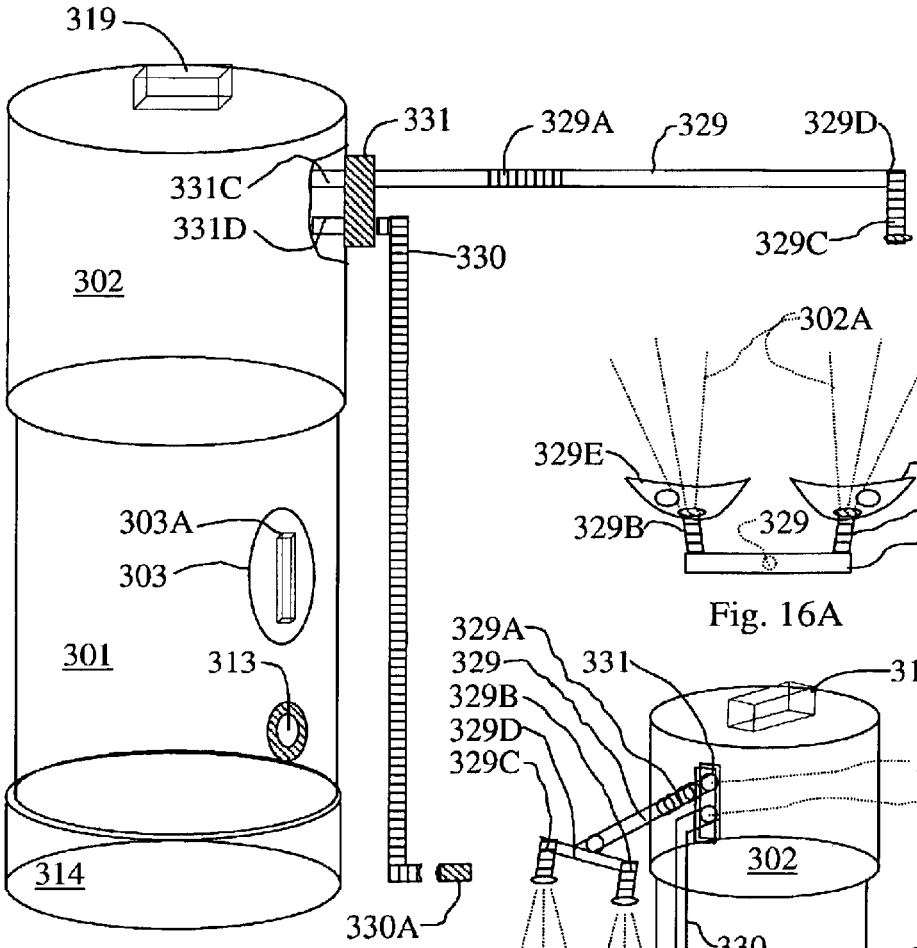
FIG. 15 shows a diagrammatic partially cutaway view of the device of FIG. 5 connective with a flexibly rigid fluid conduit extension system.
Figure 16A:
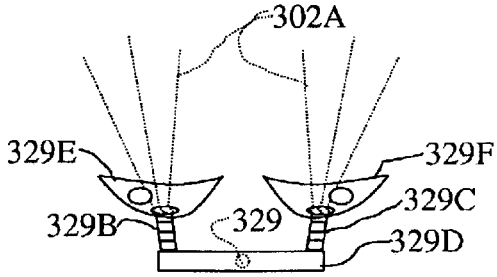
FIG. 16A shows an inverted dual flexible nozzle system.
Figure 16:
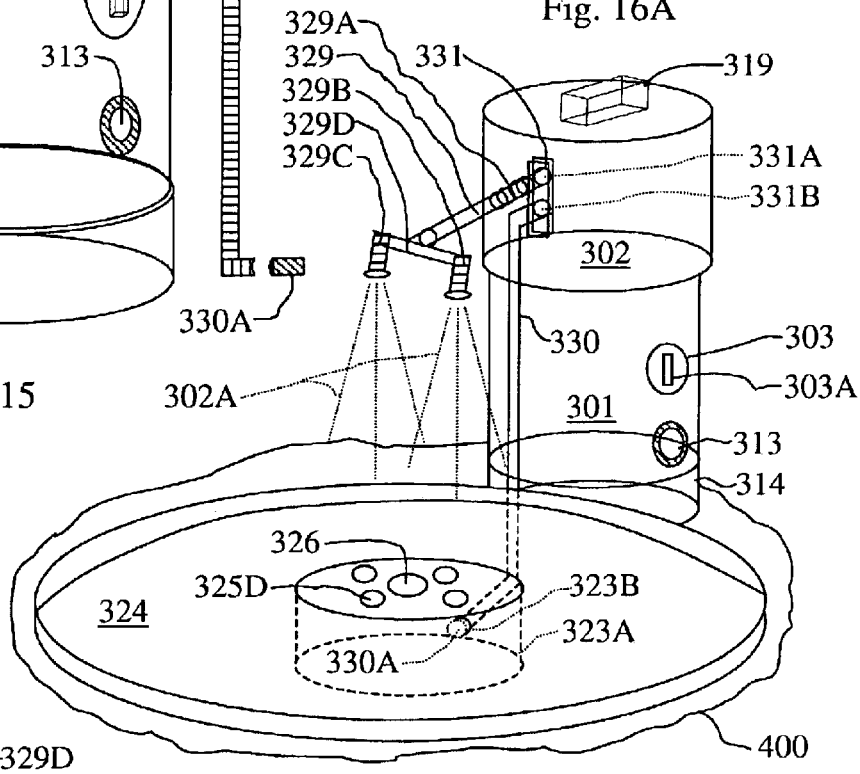
FIG. 16 shows a diagrammatic view of the device of FIG. 5 in use with a flexibly rigid fluid conduit extension system further connective with the portable basin of FIG. 13.
Figure 15A:
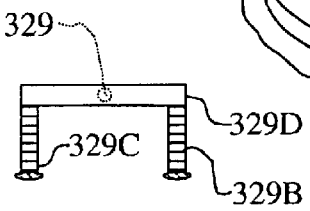
FIG. 15A shows a front view of a dual flexible nozzle system.

Referring to FIGS. 15, 15A, 16, 16A, FIG. 15 shows a diagrammatic partially cutaway view of the device of FIG. 5 connective with a flexibly rigid fluid conduit extension system. FIG. 16 shows a diagrammatic view of the device of FIG. 5 in use with a flexibly rigid fluid conduit extension system further connective with the portable basin of FIG. 13. FIG. 15A shows a dual flexible nozzle system. FIG. 16A shows an inverted dual flexible nozzle system. When portable basin 324 is connective with the flexibly rigid fluid conduit extension system, the system serves to convert the device of FIG. 5 into a portable, free-standing device with a directed fluid dispersal system flexibly positioned over basin 324. The primary distinction between the flexible dual-hose system just explained and the flexibly rigid conduit system explained below is that whereas the dual-hose system requires that outlet hose 320A with adjustable nozzle 320C be manually directed over the area to be flushed (as shown in FIG. 14), the flexibly rigid system (as shown in FIG. 16) has a flexibly rigid tube assembly 329 which extends midway over portable basin 324 and provides a flexible dual adjustable nozzle system which may be inverted (as shown in FIG. 16A) and utilized for flushing two eyes simultaneously.

Components previously explained in terms of detailed drawings 5, 7, 13, 14, have been omitted for clarity in FIGS. 15, 16. Referring to diagrammatic FIGS. 15, 15A, 16, 16A, the flexibly rigid fluid conduit extension system comprises:

a. a plastic or other polymeric material, flexibly rigid, T-shaped, fluid outlet tube assembly 329 which has a predetermined length which reaches approximately half the distance across portable basin 324. Tube assembly 329 has a manufactured-in, short flexible length portion 329A near to its straight end. Flexible length portion 329A allows tube assembly 329 to be directed at an adjustable angle over portable basin 324. Tube assembly 329 also has a set of short, right-angled, flexible nozzle extensions, a rotatably adjustable right extension 329B, and a rotatably adjustable left extension 329C, which are manufactured as parts of a cross-portion of T-shaped tube assembly 329, being a cross tube 329D.

b. a predetermined length of neoprene or other material, flexible inlet extension tubing 330. Flexible tubing 330 has a plastic or other polymeric material, pressure-fit rigid insertion tip 330A at one end for insertably connecting within inlet aperture 323B.

c. a plastic or other polymeric material block inlet/outlet member 331 with a set of molded-in holes on its front side, an upper outlet hole 331A, and a lower inlet hole 331B, suitably sized and spaced to snugly accept the straight end of tube 329 and the non-tipped end of tube 330. Inlet/outlet member 331 also has a molded-in tubular set of suitably sized and spaced protruding tips, an upper outlet tube tip 331C, and a lower inlet tube tip 331D, which are respectively suitably sized and spaced to allow their passage through container top 302 holes 318A, 318B and rim 301A holes 318C, 318D to reach a snug insertion into top cap 302 outlet and inlet channels 317A, 317B.

Inlet extension tubing 330 is of sufficient length to reach between its connection point at one end with inlet aperture 323B of cap 323A, and its opposite end connection point with inlet channel 317B in cap 302. Sufficient space is left in tube assembly 329 between the rear of flexible length portion 329A and mounting block 331 to allow tube assembly 329 to be grasped and made rotatable within its mounting hole in block 331. Or, alternately, cross tube 329D may have a small end cap snugly fit over the end of tube assembly 329 which allows it to be rotated 180° so that flexible nozzles 329B, 329C may be upwardly directed when used for flushing two eyes simultaneously.

To utilize the flexibly rigid fluid conduit extension system, the rigid protruding tips 331C, 331D of inlet/outlet member 331 are inserted into top cap 302 as shown in FIGS. 15, 16, and as explained above. Flexible tubing tip 330A is then inserted into cap 323A aperture 323B as explained above, and container 301 and basin 324 (set upon inverted container cap 323A) are set upon a level surface 400. Container 301 is then appropriately turned so that flexibly rigid tube assembly 329 is positioned and flexibly angularly adjusted properly over a desired portion of portable basin 324.

Referring to FIGS. 15A, 16A, if the flushing procedure is for a dual eye flushing purpose, cross tube 329D will be rotated 180° so that tube assembly 329 is inverted and flexible nozzle extensions 329B, 329C are facing upwards, after which they may be flexibly angularly adjusted to accommodate the eye separation sizing of the victim and rotatably adjusted to provide a thicker fluid stream. Alternately, opaque or clear plastic or other polymeric material hemispherical cups with one or more drain holes, a right eyecup with drain hole 329E, and a left eyecup with drain hole 329F, as illustrated in FIG. 16A, may be added to or manufactured in connection with flexible adjustable nozzle extensions 329B, 329C to serve as spray directors and to also serve as eyecups when cross tube 329D is inverted for dual eye flushing purposes. If eyecups with drain holes 329E, 329F are present in the embodiment, they are utilized for dual eye flushing by being placed near to or against the eye sockets during the flushing procedure and allowing contaminated spillage to run from their respective drain holes into basin 324. Alternately, an embodiment may be made wherein eyecups with drain holes 329E, 329F are provided with a Y-shaped attachment which connectively leads from their respective drain holes to a return drain tube for connection with inlet aperture 323B in cap 323A or directly into inlet channel 317B in top cap 302.

The operation of the flexibly rigid fluid conduit extension system is essentially the same as that described above for the flexible dual-hose system, i.e. on/off switch 313 on container 301 is switched on which actuates pump P and the fluid transport system, which then causes fluid spray 302A to pass through outlet tube assembly 329 and on to the victim's affected body parts. Spillage and runoff drainage from the flushing procedure is then collected within basin 324 and inverted cap 323A and returned within the fluid transport system of container 301 via suctioning through flexible inlet tube 330.

When inlet/outlet member 331 is no longer required in the fluid transport system, it is pulled free from channels 317A, 317B and inlet/outlet return member 319 is restored to cap 302 as was previously explained. The flexibly rigid fluid conduit extension system may then stored on the side for later decontamination after which it may again be stored in storage container 323 (as shown in FIG. 12).

Conclusions, Ramifications and Scope

There are any number of ways to design an effective manually or electrically operated implementation device for use with the small-scale portable recyclable fluid flushing method of the present invention. The embodiments shown and described herein represent only a few of the simplest possible and least expensive ways to produce effective manually and electrically operated implementation devices for the method. The indicated components of the various implement devices of the method of the invention are not limited to any specific materials or to manufacture by any specific process. It should be obvious to those skilled in the related arts that many different materials and various manufacturing techniques may be employed. There are also many alternate forms that the various components of the implementation devices of the method may take without departing from the spirit and scope of the method of the invention.

For example, alternately, a portable recyclable flushing fluid container may be of any suitable shape, size, color, or color-coding, and may be utilized in any angular or horizontal orientation in addition to the vertical orientation shown and described, or may be otherwise shaped and sized to be either more ergonomically designed or to suit a particular need, and so be made of various suitable irregular or classic forms. For example, alternately, a portable recyclable flushing device may be as small as a hand-held unit or as large as a hand-carried device which could be placed on a table or on a stand for use where on-site contamination is likely, e.g., a police testing range for OC or Mace™ etc., or at a work site where chemicals or small debris particles may accidentally be carried into the eyes or on the skin. Alternately, an embodiment of the invention may be provided with means for tethering or hanging it from a storage means, or for clipping to a belt, e.g., a law enforcement officer's duty rig.

Alternately, a flushing fluid container may have any type of portable fold-down catch basin, e.g. a singularly hinged, wraparound plastic basin that folds downward from the base of the container and unwraps into a flat or parabolic basin to which a drain tube may be incorporated or be attached; or, in another example, where an umbrella-like fold-down catch basin is present wherein the container is the central vertical portion of the basin; or an eye flushing basin could be provided which folds down from a hinge in a flushing container top cap. Similarly, flushing container top caps need not be wholly removable but may be hinged, tethered, or otherwise made foldably connective with a flushing container. Or, alternately, a flushing container top cap need not be removable at all, but may designed to rotate so that cutaway portions of itself cover critical components such as a spray nozzle and/or a pump lever or electric switch when the cap is turned in one direction, and reveal the same when the cap is turned in another direction.

Alternately, various fluids may be packaged with and utilized in conjunction with a portable recyclable flushing device such as a non-irritating baby wash, e.g., Johnson's Baby Wash™, which is typically utilized by working into a lather which is "blinked" into an eye that has been struck with O.C. to remove the oily residue, after which the eye would be flushed with the flushing implementation device. And, alternately, other suitable liquid solutions or diluents such as glycerin or phenol may be added to the flushing solution. Flushing fluid may be also be provided with a suitable preservative, or be of a readily available type such as Eyesaline™, which will allow a fluid container to hold a useable flushing fluid over extended periods of time.

Alternately, a disposable or reusable pump system could be aerosol driven or otherwise driven by compressed gases, or be provided with a gravity-rod steady flow pump system where a suitable weight is pulled up along with a piston which when released goes down to force fluids through an outlet.

Alternately, a dual-hose outlet/inlet fluid transport system may be provided wherein the dispersal outlet is within the tip of a funnel and the recovery suction inlet is connective within rim holes in the outer periphery of the funnel rim. And alternately, inlet and outlet fluid conduit extensions may have coiled or retractable conduits. And, alternately, an adjustable rate flow petcock or other valve device could be provided in a fluid transport system to be used in addition to a nozzle to adjust rate flow through a nozzle. And alternately, a nozzle could be provided with a pulsing feature, or have a rotating shutter for altering nozzle size from a fine point to spray to fluid stream. Alternately, nozzles that utilize varying spray patterns and fluid velocity controllers need not be permanently affixed to the ends of dispersal tubes or channels but may be variously exchangeable by insertion and withdrawal or by screw on/off or other alternate methods.

Alternately, filters for the various implementation devices of the method could have drain and outflow filters provided with a reverse backflow cleaning method with appropriate drain valves to the outside of the container, or have readily interchangeable filters for varying use circumstances. And alternately, various implementation devices could have provided appropriate cleaning devices, e.g., brushes with appropriate cleaning fluids for the type of contaminants encountered. And alternately, container portions or filter portions could have magnetic base portions to capture ferrous metal particles within encountered contaminants. And alternately, an implementation device may have various types of sensors to monitor and control the irrigant fluid quality and quantity.

Alternately, in lieu of a conventional charging system for its rechargeable batteries, an electrically operated implementation device may use magnets to cause mutual induction to charge the batteries in the device so that the charger acts as a transmitter of the charge currents and the battery unit is tuned to be a receiver of the charger currents, effectively transferring energy by means of mutual induction. Alternately, a shaker type of charging system using similar magnetic induction charging principles may be utilized in an implementation device. And, alternately, implementation devices of the invention may be provided with an electrical illumination device, such as a flashlight, for use in the dark.

Alternately, the use of the device is not limited to the flushing of human eyes or other parts of a human body, but may be utilized for flushing the eyes or other parts of an animal's body.

Essence of the Invention

From all of the drawings, descriptions and accounts of operation of the various implementation embodiments cited above for the present invention, the essence of the invention as a small-scale portable recyclable fluid flushing method used for flushing irritants or inflammatory agents from the skin or eyes, or for flushing infectious debris from wounds is that it has:

1. a single or plurally chambered container with at least one flushing fluid chamber filled with an uncontaminated flushing fluid appropriate for the intended flushing procedure;
2. a first outflow fluid conduit, e.g., a channel or tube, which transports uncontaminated fluid from the container flushing fluid chamber to a pump or impeller housing;
3. a manual or electrically operated pump or impeller for transporting uncontaminated fluid through to a second outflow fluid conduit to a dispersal outlet or nozzle;
4. a fluid runoff collector surrounding the dispersal outlet, or a catch basin situated below the dispersal outlet, either of which acts as a sump to capture the contaminated runoff fluid from the flushing procedure;
5. a first drain fluid conduit;
6. an optional one-way elastomeric drain valve, e.g., a rubberlike synthetic polymer duckbill valve, such as silicone rubber, or other form of check valve preceding the first drain fluid conduit to avoid reverse flow spillage;
7. an appropriate sealed filter media unit suitably housed in line with the first drain fluid conduit or before the first outflow fluid conduit for decontamination of the contaminated fluid run-off from the drain;
8. a second drain fluid conduit to re-introduce the reclaimed decontaminated fluid from the sealed filter media back into the flushing fluid chamber for re-introduction to the fluid transport system;
9. an optional second outflow fluid filter for final removal of any residual contaminants prior to re-introduction to the first outflow fluid conduit.

The portable recyclable fluid flushing method of the invention provides a reliable emergency supply of flushing fluid for continuous flushing dispersal onto an affected body part. If a device bearing the specific combination of manufacturing components, configurations and other parameters as just specified were made and referred to by others as, for example, a "recyclable liquid dispenser for cleaning chemical spills on the body," or the like, each would be, by direct reference or implication, implementation devices of the method of the present invention. The several embodiments described above are only illustrative examples of the present invention and it should not be construed that the present invention is limited to those particular embodiments. Various changes and modifications in alternate embodiments of the present invention, as noted above or as may be determined in the future, may be effected by one skilled in the art to which the invention relates without departing from the spirit or scope of the present invention as defined in the appended claims.

I claim:

1. A small-scale portable recyclable fluid flushing device used for flushing irritants or inflammatory agents from the eyes or skin, or for flushing infectious debris from wounds, comprising:

a. a container having a top rim and at least one fluid chamber containing a predetermined amount of uncontaminated flushing fluid appropriate for the intended flushing procedure, said top rim having a rim outlet hole and a rim inlet hole;

b. an outlet fluid conduit leading from said at least one fluid chamber;

c. a fluid transport pump for transporting said uncontaminated flushing fluid to said outlet fluid conduit so that said uncontaminated flushing fluid is pumped from said at least one fluid chamber through an outlet nozzle;

d. a fluid collector located below said outlet nozzle for collecting said contaminated flushing fluid runoff from said flushing procedure, wherein said fluid collector comprising a drain aperture, a drain filter housed in line with said drain aperture for decontaminating said contaminated flushing fluid run-off from said drain aperture, and an outlet tube extending from said drain filter to said at least one fluid chamber for re-introducing reclaimed said decontaminated flushing fluid from said drain filter back into said at least one fluid chamber for re-introduction of the flushing fluid through said outlet fluid conduit to said fluid transport pump, thereby providing a continuous reliable emergency supply of decontaminated flushing fluid for continuous flushing dispersal from said outlet nozzle onto said eyes or skin, or wounds;

e. a plastic cap removably attached to said container at said top rim, said cap having an extender block with an outlet channel and an inlet channel formed therein, said outlet channel further having a molded-in outlet nipple which is sized to sealing mate with said outlet nozzle, said inlet channel further having a molded-in inlet nipple which is sized to sealing mated with said drain aperture, said cap further having a cap outlet hole and a cap inlet hole that are aligned with the end portion apertures of said outlet channel and inlet channel, respectively, wherein said cap outlet and inlet holes are further aligned with said rim outlet and inlet holes, respectively, therefore, a through passage is formed between the outside of said cap, through said rim and into said outlet and inlet channels.

2. The small-scale portable recyclable fluid flushing device of claim 1 further including a one-way drain check valve preceding said first drain fluid conduit.

3. The small-scale portable recyclable fluid flushing device of claim 1 further including an inlet filter for said fluid transport pump in addition to said drain filter and said outlet tube.

4. The small-scale portable recyclable fluid flushing device of claim 1 further including an inlet filter for said fluid transport pump which replaces said drain filter and said outlet tube.

5. The small-scale portable recyclable fluid flushing device of claim 1 wherein said fluid transport pump is a manually operated fluid transport pump.

6. The small-scale portable recyclable fluid flushing device of claim 1 wherein said fluid transport pump is an electrically operated fluid transport pump.

7. The small-scale portable recyclable fluid flushing device of claim 1 wherein said drain filter has filtering media able to remove chemicals and oils from said contaminated flushing fluid.

8. The small-scale portable recyclable fluid flushing device of claim 1 further including a flexible dual-hose fluid conduit extension system.

9. The small-scale portable recyclable fluid flushing device of claim 1 further including a flexibly rigid fluid conduit extension system.

10. The small-scale portable recyclable fluid flushing device of claim 1 wherein said fluid collector is a portable basin.

11. A small-scale portable recyclable fluid flushing device used for flushing irritants or inflammatory agents from the eyes or skin, or for flushing infectious debris from wounds, comprising:

a. a container having a top rim and at least one fluid chamber containing a predetermined amount of uncontaminated flushing fluid appropriate for the intended flushing procedure, said top rim comprising a thin, upper-encircling annular wall formed into the material of its upper portion, said top rim extending upwardly a predetermined uniform distance above the horizontal plane of a drain basin plate, b. an outlet fluid conduit leading from said at least one fluid chamber;

c. a fluid transport pump for transporting said uncontaminated flushing fluid connected to said outlet fluid conduit so that said uncontaminated flushing fluid is pumped from said at least one fluid chamber through an outlet nozzle said outlet nozzle extending above and beyond said top rim;

d. a fluid collector located below said outlet nozzle for collecting said contaminated flushing fluid runoff from said flushing procedure, wherein said fluid collector comprising a drain aperture, a drain filter housed in line with said drain aperture for decontaminating said contaminated flushing fluid run-off from said drain aperture, and an outlet tube extending from said drain filter to said at least one fluid chamber for re-introducing reclaimed said decontaminated flushing fluid from said drain filter back into said at least one fluid chamber for re-introduction of the flushing fluid through said outlet fluid conduit to said fluid transport pump, whereby, when said small-scale portable recyclable fluid flushing device is used for said flushing of irritants or inflammatory agents from said skin or eyes, or for flushing infectious debris from wounds, the outer surface of said container having a top rim may be presed against a portion of uncontaminated skin below contaminated said skin, eyes or wounds, so that a continuous reliable emergency supply of said decontaminated flushing fluid for continuous flushing dispersal from said dispersal outlet may be dispersed onto said skin or eyes, or wounds, and said contaminated flushing fluid runoff be reclaimed by said fluid collector.

12. The small-scale portable recyclable fluid flushing device of claim 11 further including a one-way drain check valve preceding said drain aperture.

13. The small-scale portable recyclable fluid flushing device of claim 11 further including an inlet filter for said fluid transport pump in addition to said drain filter and said outlet tube.

14. The small-scale portable recyclable fluid flushing device of claim 11 further including an inlet filter for said fluid transport pump which replaces said drain filter and said outlet tube.

15. The small-scale portable recyclable fluid flushing device of claim 11 wherein said fluid transport pump is a manually operated fluid transport pump.

16. The small-scale portable recyclable fluid flushing device of claim 11 wherein said fluid transport pump is an electrically operated fluid transport pump.

17. The small-scale portable recyclable fluid flushing device of claim 11 wherein said drain filter has filtering media able to remove chemicals and oils from said contaminated flushing fluid.

18. The small-scale portable recyclable fluid flushing device of claim 11 further including a protective top cap for said container having a top rim.

19. The small-scale portable recyclable fluid flushing device of claim 11 further including a viewing strip in said container having a top rim for visually determining the amount of said predetermined amount of uncontaminated flushing fluid remaining in said at least one fluid chamber.

20. The small-scale portable recyclable fluid flushing of claim 11 further including a fluid filter color indicator in said container having a top rim for visually determining when the useful life of said filter media is ending.

* * * * *